US010986929B2

(12) United States Patent
Levin et al.

(10) Patent No.: US 10,986,929 B2
(45) Date of Patent: Apr. 27, 2021

(54) FOLDABLE BACKREST

(71) Applicant: Stav Levin, Bi-Tan Aharon (IL)

(72) Inventors: Stav Levin, Bi-Tan Aharon (IL); Omri Segal, Tel Aviv (IL)

(73) Assignee: SUNBOARD LTD., Bi-Tan Aharon (IL)

( * ) Notice: Subject to any disclaimer, the term of this patent is extended or adjusted under 35 U.S.C. 154(b) by 0 days.

(21) Appl. No.: 16/611,378

(22) PCT Filed: Dec. 19, 2018

(86) PCT No.: PCT/IL2018/051374
§ 371 (c)(1),
(2) Date: Nov. 6, 2019

(87) PCT Pub. No.: WO2019/123460
PCT Pub. Date: Jun. 27, 2019

(65) Prior Publication Data

US 2020/0163461 A1 May 28, 2020

Related U.S. Application Data

(60) Provisional application No. 62/607,953, filed on Dec. 20, 2017.

(51) Int. Cl.
*A47C 16/00* (2006.01)
*A47C 20/02* (2006.01)
(Continued)

(52) U.S. Cl.
CPC ..... *A47C 16/005* (2013.01); *A47C 1/146* (2013.01); *A47C 7/407* (2013.01); *A47C 7/42* (2013.01); *A47C 20/027* (2013.01)

(58) Field of Classification Search
CPC ..... A47C 16/005; A47C 7/42; A47C 7/407; A47C 1/146; A47C 20/027
(Continued)

(56) References Cited

U.S. PATENT DOCUMENTS 319,537 A * 6/1885 Winter ..... A47C 20/027 5/634
405,038 A * 6/1889 Koechling ..... A47C 1/146 297/377
(Continued)

FOREIGN PATENT DOCUMENTS

CN 2798735 7/2006
CN 104203188 12/2014
(Continued)

*Primary Examiner* — Robert Canfield
(74) *Attorney, Agent, or Firm* — Law Offices of Steven W. Weinrieb

(57) ABSTRACT a foldable backrest, including a backrest plate, operatively configured to be leaned upon by a back of a user. A support plate pivotally connected to the backrest plate operatively configured to be placed on a surface on which a user desires to sit or lay down on. One or more movable rigid wedges configured to form a desired angle between the backrest plate and the support plate in respect to the pivot connection between the backrest plate and the support plate. One or more wedge-stopping means for fixing the movable rigid wedge in a position for forming the desired angle. The one or more movable rigid wedge(s) configured to transfer mechanical support to the backrest plate from a surface on which support plate is positioned when the rigid wedge is fixed in a desired position by the wedge-stopping means.

16 Claims, 9 Drawing Sheets

(51) Int. Cl.
*A47C 7/42* (2006.01)
*A47C 7/40* (2006.01)
*A47C 1/14* (2006.01)

(58) Field of Classification Search
USPC ..... 297/17, 129, 31, 230.1, 230.12, 352, 297/354.12, 357; 190/8; 224/155; 5/634, 660
See application file for complete search history.

(56) References Cited

U.S. PATENT DOCUMENTS 1,103,730 A * 7/1914 Anderson ..... A47C 20/027 5/634
1,151,894 A * 8/1915 Meincke ..... A47C 20/027 5/634
1,647,297 A * 11/1927 Johnson ..... A47C 1/146 297/372
2,014,614 A * 9/1935 Czygan ..... A47C 1/146 297/184.15
2,368,436 A * 1/1945 Williams ..... A47C 20/027 5/634
2,429,795 A * 10/1947 Blanchard ..... A47C 1/16 297/118
2,570,571 A * 10/1951 Leeman ..... A47C 1/146 190/8
2,663,029 A * 12/1953 Whitley ..... A47C 20/043 5/634
3,018,132 A * 1/1962 Baker ..... A47C 1/146 297/377
3,121,884 A * 2/1964 Emery ..... A47C 1/146 5/634
3,276,817 A * 10/1966 Marple ..... A47C 1/146 297/377
3,441,312 A * 4/1969 Loeb ..... A47C 4/08 297/374
3,800,338 A * 4/1974 Smith ..... A61G 7/015 5/617
3,952,346 A * 4/1976 Carlson ..... A47C 20/04 5/660
4,908,891 A * 3/1990 Blagg ..... A47C 1/146 297/352
5,299,337 A 4/1994 Venza
5,425,567 A 6/1995 Albecker, III
5,701,979 A * 12/1997 Voich ..... A45F 4/02 190/8
6,139,567 A * 10/2000 McCarty ..... A47C 4/52 5/633
6,250,712 B1 * 6/2001 Livington ..... A47C 1/146 297/129
6,561,582 B1 * 5/2003 Steadman ..... B60N 2/2821 297/188.2
7,201,170 B2 * 4/2007 Espinosa ..... A47C 15/008 128/845
7,478,445 B2 * 1/2009 De Vries ..... A61B 6/0442 5/601
8,857,906 B2 * 10/2014 Connors ..... A61G 7/07 297/230.14
10,631,619 B2 * 4/2020 Alphin ..... A47C 1/146
2002/0135219 A1 9/2002 Rogers
2003/0106915 A1 * 6/2003 Jo ..... A47C 4/52 224/155
2007/0236055 A1 * 10/2007 Gausman ..... A47C 1/146 297/129

FOREIGN PATENT DOCUMENTS

DE 3219116 11/1924
DE 3142104 A1 * 5/1983 ..... A47C 1/146
DE 10139982 A1 * 3/2003 ..... A47C 1/146
EP 139957 A2 * 5/1985
FR 773150 A * 11/1934 ..... A47C 1/146
FR 2922738 A1 * 5/2009 ..... A47C 20/043
GB 190501376 A * 7/1905
GB 615942 1/1949
GB 2419815 A * 5/2006 ..... A47B 23/001
GB 2464451 4/2010
JP 09248321 A * 9/1997 ..... A47C 20/027
JP 2003-245166 9/2003
WO WO 2011082465 7/2011
WO WO-2011082465 A1 * 7/2011

* cited by examiner

FOLDABLE BACKREST

FIELD OF THE INVENTION

The present invention relates to seating devices, in particular to foldable backrests.

BACKGROUND OF THE INVENTION

Comfortable staying on the ground in a full lying position may be either on the back or the belly. However, during full lying on the back or belly, it is impossible to comfortably perform activities like reading, writing, view viewing, eating and the like. Such activities are normally performed in a sitting position, which is not comfortable when performed on the ground, due to the lack of support to the nape and back. Furthermore, if one desires to lie in an angled position, namely partially lying backwards while the back does not touch the ground, in order to perform such activities, one has to lean on the ground with his or her hands or elbows for supporting the nape and back. Of course, at this position the hands are not free for performing desired activities. In addition, leaning on the hands and elbows for a prolonged period of time is not comfortable and occasionally accompanied with pain.

In order to facilitate lying, or sitting, or partially lying on the ground, various devices for this purpose are currently available, namely sitting devices and backrests. Generally, three types of devices for sitting, lying and partially lying on the ground, especially but not necessarily for being used outdoors, are known in the art: sitting devices, backrests and inflatable sitting or lying devices.

FIGS. 1A-1D illustrate a perspective view of various exemplary of a prior art sitting device. Such sitting devices allow either sitting, as illustrated in FIGS. 1A-1C, or partially lying, as illustrated in FIG. 1D, or even full lying down (not shown). However, sitting on such sitting devices is on a higher level than that of the ground, while sitting or lying directly on the ground level is impossible. These sitting devices also require carrying them using user's hands and shoulders and thus it is not comfortable to carry such foldable sitting devices in particular when the user needs to carry more things with his hands. In addition, the sitting devices that are shown for example in FIGS. 1A-1D require a square frame around which harms comfort, limits the design freedom of the backrest and renders the use of such devices cumbersome.

FIGS. 2A-2D illustrate a perspective view of various exemplary embodiments of a prior art backrest. A prior art backrest comprises a frame, made for example of metal like aluminum, wood and the like; and a flexible material, like fabric, stretched over the frame. Thus, in a prior art backrest the frame is rigid and the main area of the backrest, on which a user mostly leans, is soft and flexible or unstable, devoid of a definite structure, because it is made of a flexible material, like fabric. Furthermore, the rigid frame of a prior art backrest does not allow comfortable leaning, especially leaning the head, on the backrest. In addition, their mechanism requires a tough frame that affects not only the comfort but the possibilities of shaping the frame shape of the backrest itself.

FIGS. 3A-3B illustrate a perspective view of various exemplary embodiments of a prior art inflatable sitting or lying device. A prior art inflatable sitting or lying device is made of a flexible material, for example fabric, rubber, plastic and the like, that is configured to be inflated with air and get a structure that allows sitting or lying on the device.

The prior art inflatable sitting or lying device has several drawbacks, including: having a fixed structure, thus allowing sitting or lying only in one fixed position; the inflatable devices are prone to loss of air due to contact with sharp objects and due to constant wear and tear; there is a need to inflate the device prior usage, for example with the mouth or a pump, thus rendering the usage cumbersome; such devices cannot be carried as a backpacks and the material of which the device is made is normally impermeable, thus causing excess perspiration of the user, especially during the summer when such devices are widely used.

Backrests are also addressed for example in CN202086044, CN102525770, WO2011082465 and U.S. Pat. No. 5,701,979.

CN202086044 discloses a folding chair used on a bed and belongs to articles for daily use. The folding chair comprises a back and a seat cushion. The lower end of the back is connected with a base through a movable shaft. The seat cushion is arranged at the front end of the base, a clamping groove is arranged at the rear end of the base, one end of a support is connected with the back through a shaft, and the other end of the support is arranged inside the clamping groove. Different tooth-shaped clamping grooves can be designed on the base so that angles of inclination of human bodies can be adjusted according to comfortableness. Sponge cushions are arranged on the back, a back cushion and the seat cushion.

CN102525770 describes a bed backrest, which includes a backup plate and a base, where the two sides of the backup plate are movably connected with one end of the base, the bed backrest further includes an angle adjusting device used for adjusting angles between the backup plate and the base.

WO2011082465 describes a foldable padded beach mat with an adjustable backrest, the backrest can be adjusted by means of a stand formed by three aluminum parts. The four adjustment degrees for the backrest and the foam padding make the beach mat more comfortable, since it can be adjusted to each user. The beach mat further has a handle that makes it easier to transport in the folded state.

U.S. Pat. No. 5,701,979 describes a bag that is converted into a backrest. The fabric is folded to form a bag, and there is a zipper on one side. Three wooden structures are placed in the interior of the bag. These structures provide a back rest when the zipper is opened, and the bag is unfolded.

One object of the present invention is to provide a backrest that allows sitting, or lying, or partially lying in various angles.

Another object of the present subject invention is to provide a backrest that allows sitting on a surface, while keeping the hands free and accessible for performing any desired activity.

SUMMARY OF THE INVENTION

The present invention relates to seating devices, in particular to foldable backrests.

In accordance with an embodiment of the present invention there is provided a foldable backrest, including a backrest plate, operatively configured to be leaned upon by a back of a user. A support plate pivotally connected to the backrest plate operatively configured to be placed on a surface on which a user desires to sit or lie. One or more movable rigid wedges configured to form a desired angle between the backrest plate and the support plate in respect to the pivot connection between the backrest plate and the support plate. One or more wedge-stopping means for fixing the movable rigid wedge in a position for forming the desired angle. The one or more movable rigid wedge(s) configured to transfer mechanical support to the backrest plate from a surface on which support plate is positioned when the rigid wedge is fixed in a desired position by the wedge-stopping means. Thus, holding the backrest plate in a desired angle relative to the support plate.

BRIEF DESCRIPTION OF THE DRAWINGS

The invention may be understood upon reading of the following detailed description of non-limiting exemplary embodiments thereof, with reference to the following drawings, in which.

Figure 1A:
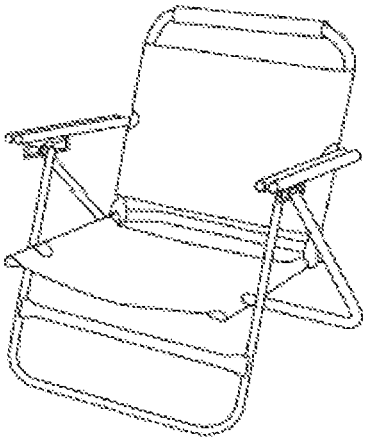
PRIOR ART Fig. 1A
FIGS. 1A-1D illustrate a perspective view of various exemplary embodiments of a prior art sitting device.
Figure 1B:
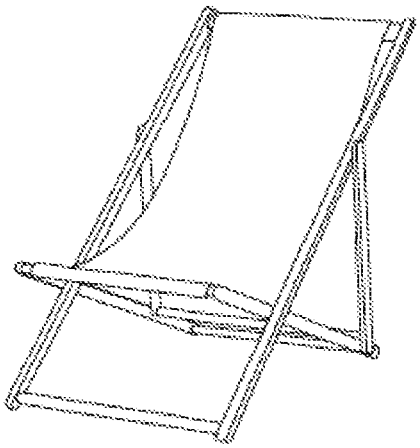
PRIOR ART Fig. 1B
Figure 1C:
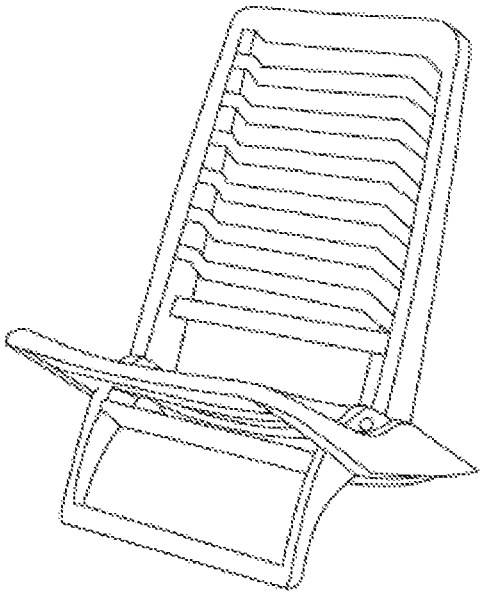
PRIOR ART Fig. 1C
Figure 1D:
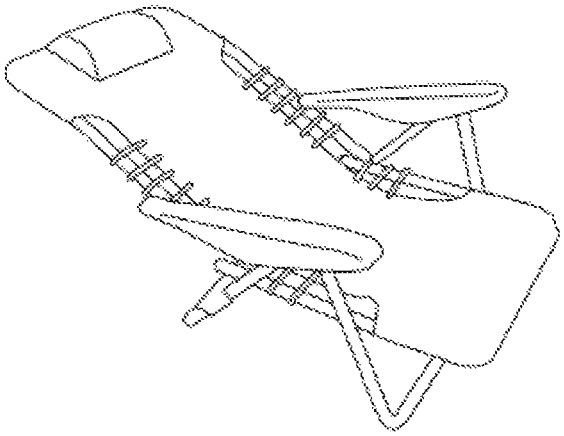
PRIOR ART Fig. 1D
Figure 2A:
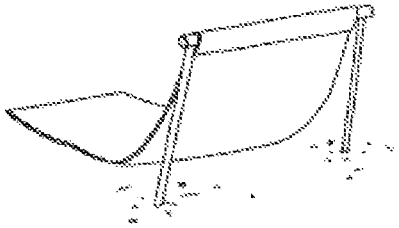
PRIOR ART Fig. 2A
FIGS. 2A-2D illustrate a perspective view of various exemplary embodiments of a prior art backrest.
Figure 2B:
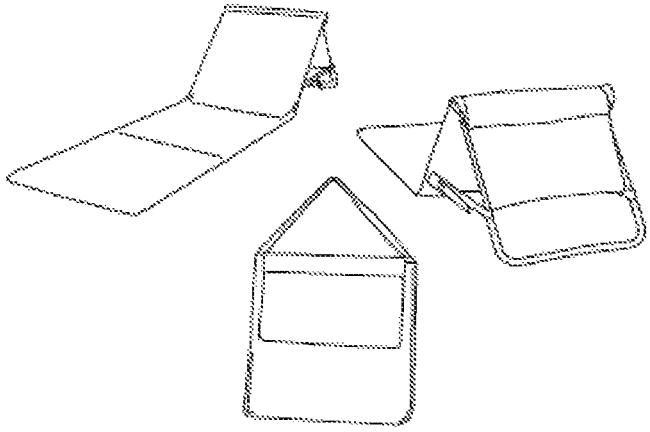
PRIOR ART Fig. 2B
Figure 2C:
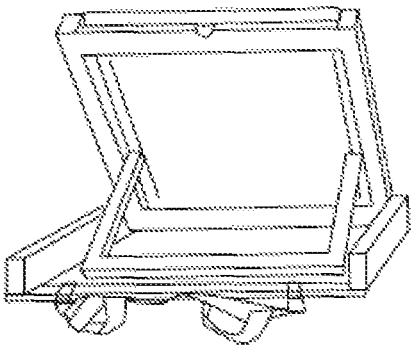
PRIOR ART Fig. 2C
Figure 2D:
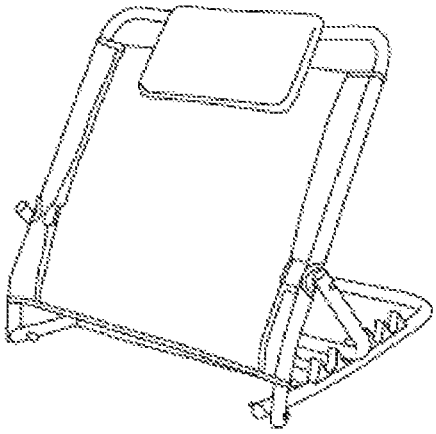
PRIOR ART Fig. 2D
Figure 3A:
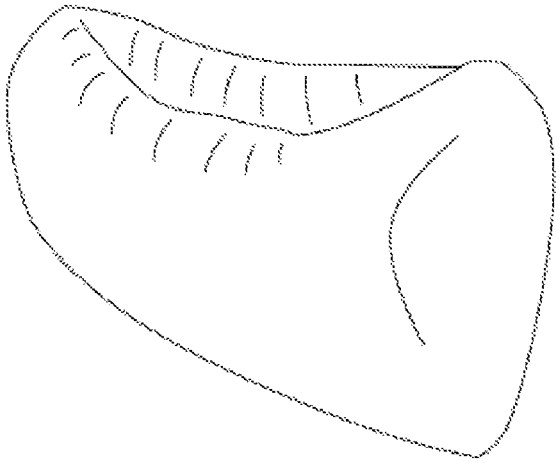
PRIOR ART Fig. 3A
FIGS. 3A-3B illustrate a perspective view of various exemplary embodiments of a prior art inflatable sitting or lying device.
Figure 3B:
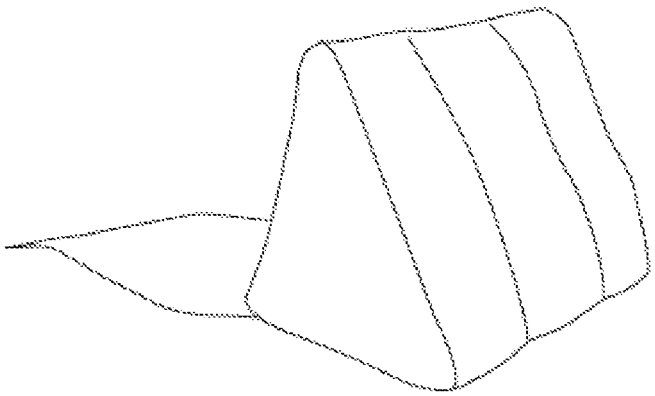
PRIOR ART Fig. 3B

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale. For the sake of simplicity only, the terms "sit" and "sitting" as used herein below may refer to any one of the aforementioned positions, or any combination of any at least two of the aforementioned positions. Optionally, the provided backrest may allow sitting in various possible angles. Optionally, the provided backrest may allow sitting on a surface, whether outdoors and/or indoors.

Figure 4A:
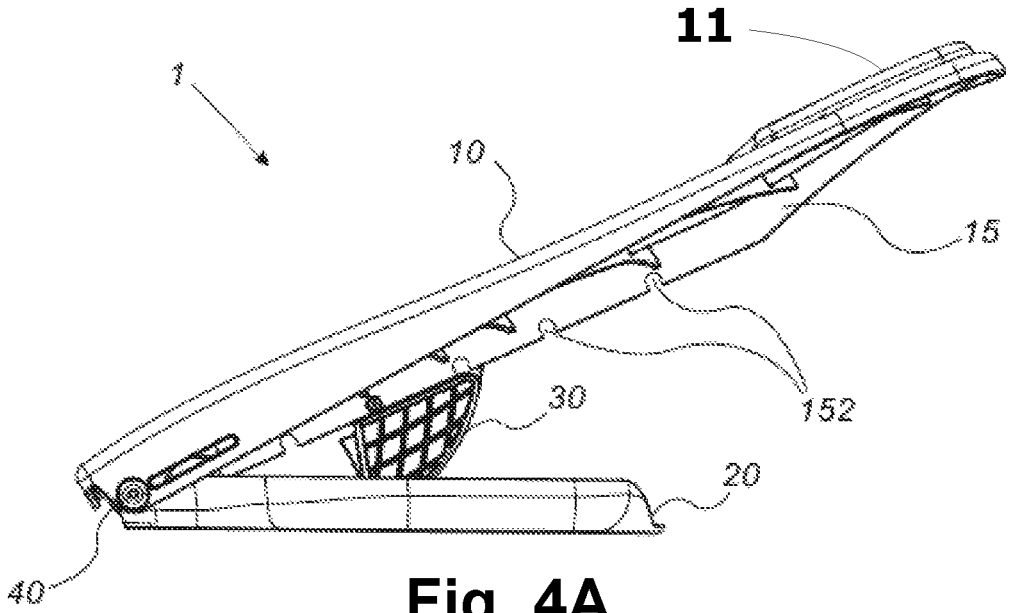
FIGS. 4A-4B schematically illustrate, according to an exemplary embodiment, a side view and a perspective back view, respectively, of a foldable backrest.
Figure 4B:
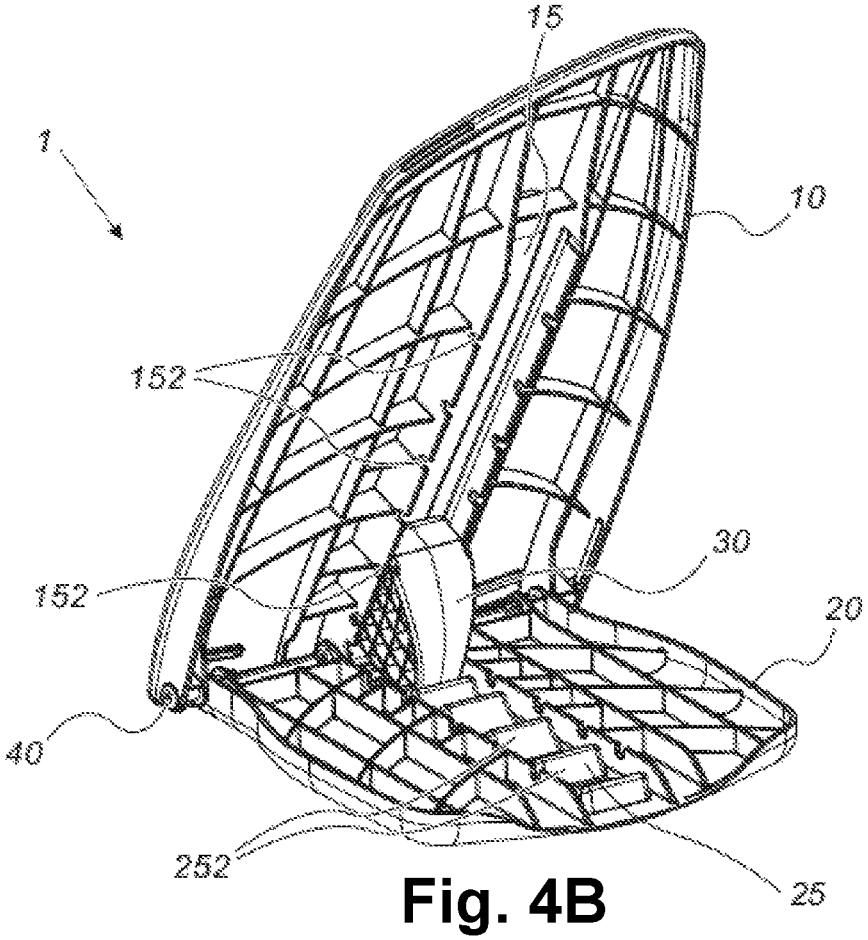

Referring to FIGS. 4A and 4B there is shown a foldable backrest 1 according to one embodiment of the present invention. The foldable backrest 1 includes a backrest plate 10 operatively configured to be leaned upon by a back of a user. Backrest plate 10 may include one or more padded portions 11. Plate 10 is pivotally connected to a support plate 20 operatively configured to be placed on a surface on which a user desires to sit, for example ground, soil, lawn, floor, surf board and the like. A side of the backrest plate 10, that is not designed to face a user's back (refers to as the back portion of the backrest plate 10) includes a rail 15 having one or more slots 152. A side of the support plate 20, that is not designed to face the surface on which a user desires to sit (refers to as the back portion of the backrest support plate 20), includes a rail 25 having one or more tooth-like structure 252. The foldable backrest 1 further includes a wedge 30 that is configured to slide along the rail 15 of the backrest plate 10 and be fixed to any one of the slots 152 of the rail 15 of the backrest plate 10. The fixing of the wedge 30 to any one of slot(s) 152 may be used, as discussed in detail below, to determine an angle between the backrest plate 10 and the support plate 20 in which a user may safely sit on the foldable backrest 1.

According to some embodiments of the present invention, backrest plate 10, support plate 20 and wedge 30 are made of a rigid material, for example but not limited to, plastic, wood, metal, acrylonitrile butadiene styrene (ABS), carbon, foam and the like. According to a preferred embodiment, the backrest plate 10, the support plate 20 and the wedge 30 are made of rigid plastic. According to some other embodiments, the backrest plate 10, the support plate 20 and the wedge 30 are made of rigid plastic and manufactured by high pressure injection or any other suitable manufacturing means known in the art.

The backrest plate 10 and the support plate 20 are pivotally connected by a pivot 40. Any type of pivot 40 is under the scope of the present subject matter, for example but not limited to, a hinge, a foldable sheet made for example of fabric connecting the backrest plate 10 to the support plate 20, and the like.

The wedge 30 is configured to slide along the rail 15 of the backrest plate 10 and be fixed to any one of slot(s) 152 along the rail 15. When the backrest plate 10 and the support plate 20 are folded one towards the other, while the rail 15 of the back rest plate 10 faces the rail 25 of the support plate 20, and the wedge 30 is fixed to one of slot(s) 152, the wedge prevents complete folding of the backrest plate 10 and the support plate 20, thus holding the backrest plate 10 in a certain angle relative to the support plate 20, as illustrated for example in FIG. 4A.

According to some embodiments of the present invention a single wedge 30 as described for example in FIG. 4B is slidable along a single rail 15 as described above, where the single rail 15 is preferably located on a central part of the backrest plate 10. According to some other embodiments (not illustrated), foldable backrest 1 may includes a plurality of wedges 30 that may slide along a plurality of rails 15 located on different parts of the backrest plate 10, for example on both left and right sides; or on a left side, middle and right side of the backrest plate 10. As described below in detail, the sliding wedge mechanism disclosed herein is advantageous over prior art solutions, and many of these advantages may be achieved by the various positions of the one or more rails 15.

Figure 5A:
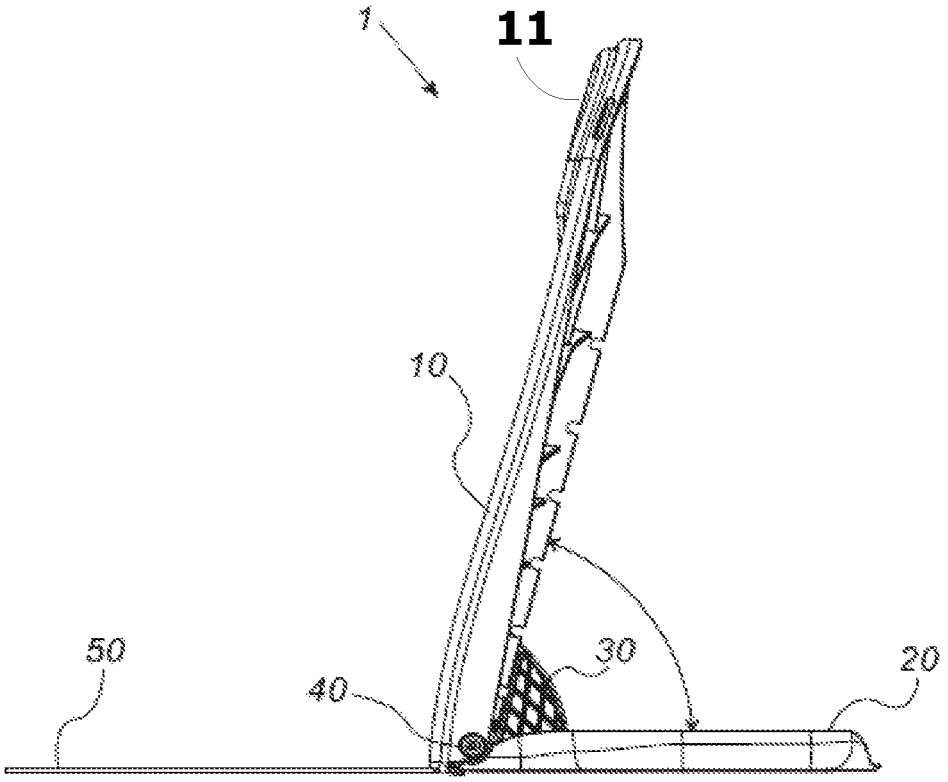
FIGS. 5A-5C schematically illustrate, according to an exemplary embodiment, a foldable backrest in various folding positions.
Figure 5B:
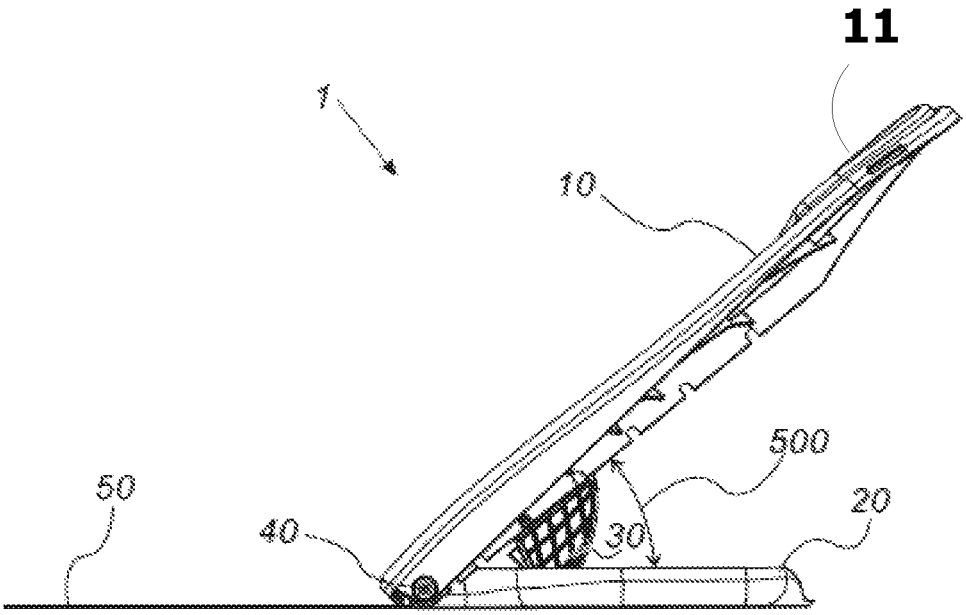
Figure 5C:
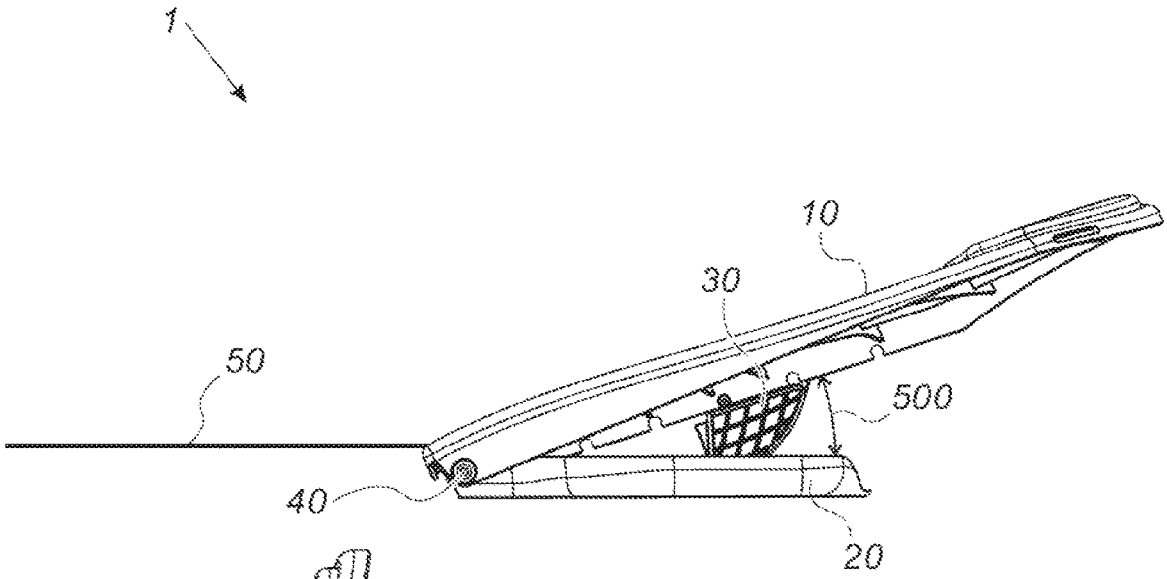

Referring to FIGS. 5A-5C schematically illustrate, according to an exemplary embodiment, a foldable backrest in various folding positions. The angle 500 between the backrest plate 10 and the support plate 20 is determined by the position of the wedge 30 along the rail 15 of the backrest plate 10. When the wedge 30 is fixed to a slot 152 adjacent to the pivot 40, the angle 500 is slightly smaller than 90°, for example about 80°, as illustrated in FIG. 5A. As the wedge 30 is fixed to a slot 152 further distant from the pivot 40, the angle 500 decreases accordingly, as illustrated in FIGS. 5B and 5C. Thus, according to an exemplary embodiment, the range of the angle 500 may be between substantially 20° and substantially 89°. However, it should be noted that this range of angle 500 is exemplary only, and that any angle 500 is under the scope of the present subject matter. Furthermore, the lowest angle 500 possible is determined by the size of wedge 30. The smaller the wedge 30, the lower is the lowest angle 500 possible to achieve. Thus, any size of the wedge 30, and accordingly any lowest angle 500 between the backrest plate 10 and the support plate 20 that may be achieved is under the scope of the present subject matter.

In addition, the number of possible angles 500 that may be fixed is determined by the number of slots 152 along the rail 15. According to an exemplary embodiment, the rail 15 comprises six slots 152, thus enabling the fixation of the wedge 30 in five positions along the rail 15 that determine five different angles 500 between the backrest plate 10 and the support plate 20. The sixth slot 152 is for completely folding the foldable backrest 1, as described hereinafter. It should be noted that this was only an exemplary number of slots 152 along the rail 15, any that any number of slots 152 along the rail 15 is under the scope of the present subject matter.

According to another embodiment, the rail 15 does not comprise slots 152, and instead the wedge 30 comprises a locking element that is configured to lock the wedge 30 in any position along the rail 15. Any locking element known in the art is under the scope of the present subject matter, for example but not limited to, a clamp-like element that clinches the rail 15 tightly and prevents movement of the wedge 30. Thus, according to this embodiment, any possible angle 500 between the backrest plate 10 and the support plate 20 may be achieved.

The feature of the foldable backrest 1, of changing the angle 500 between the backrest plate 10 and the support plate 20, allows a user to sit in various possible angles, or essentially completely lying down, easily and comfortably, simply by changing the position of the wedge 30 along the rail 15 of the backrest plate 10.

When the wedge 30 is fixed to the slot 152 that is mostly distant from the pivot 40, the foldable backrest 1 may be folded completely, namely be completely closed. This state, of completely closed foldable backrest 1 is illustrated for example in FIG. 6A.

Figure 6A:
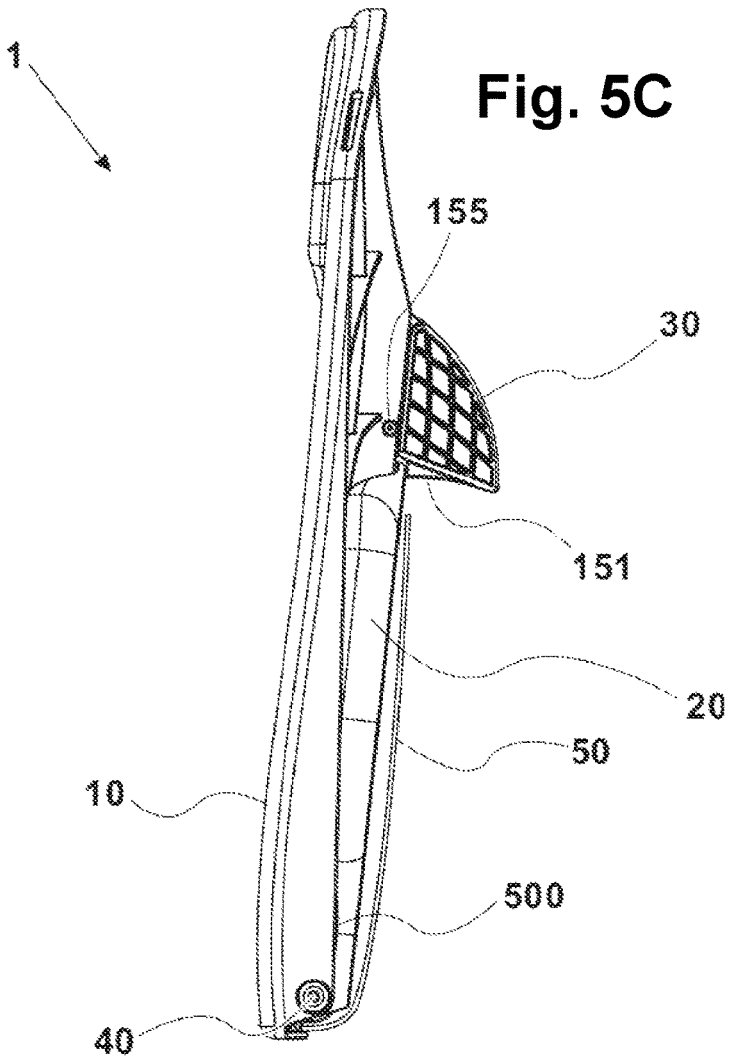
FIG. 6A schematically illustrates, according to an exemplary embodiment, a side view of a completely closed foldable backrest.
Figure 7:
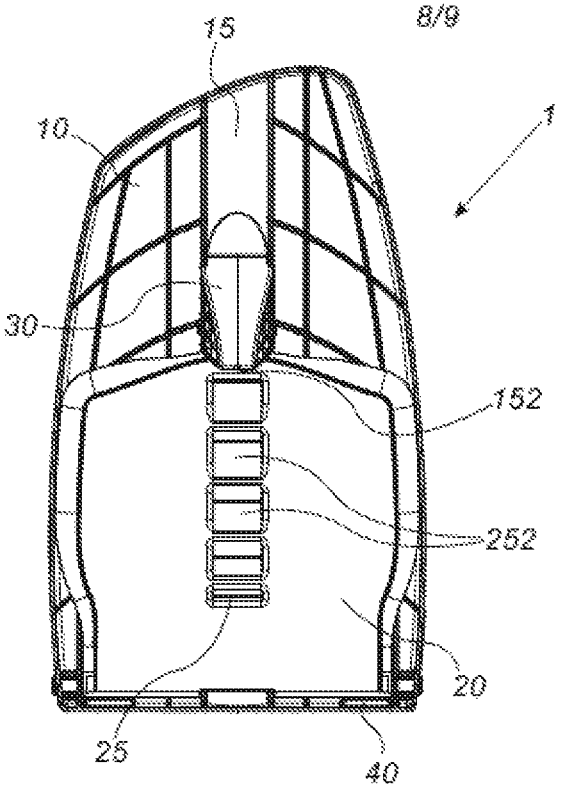
FIG. 7 schematically illustrates, according to an exemplary embodiment, a back view of a completely closed foldable backrest.

FIG. 7 for example schematically illustrates, according to an exemplary embodiment, a back view of a completely closed foldable backrest. This embodiment, of completely closed foldable backrest 1 is used during storage or carriage of the foldable backrest 1. FIGS. 6A and 7 illustrate for example a completely closed foldable backrest 1, while the wedge 30 is fixed to a slot 152 that is distant from the pivot 40 in accordance with the following limitation. In order to achieve complete folding of the foldable backrest 1, the distance between the pivot 40 and the slot 152 to which the wedge 30 is fixed should be longer than the length of the support plate 20 from the pivot 40 to the opposite edge of the support plate 20. Otherwise, the wedge 30 prevents complete folding of the foldable backrest 1, and essentially creates an angle 500 between the backrest plate 10 and the support plate 20, as illustrated for example in FIGS. 5A-C. Referring to FIG. 6A, According to the embodiment where the rail 15 includes slots 152 and the wedge 30 includes a locking element 151, complete closing of the foldable backrest 1 is achieved by locking the wedge 30 to the rail 15 at a distance from the pivot 40 that is longer than the length of the support plate 20, as described above. Thus, the locking element prevents the support plate 20 from opening.

Figure 6B:
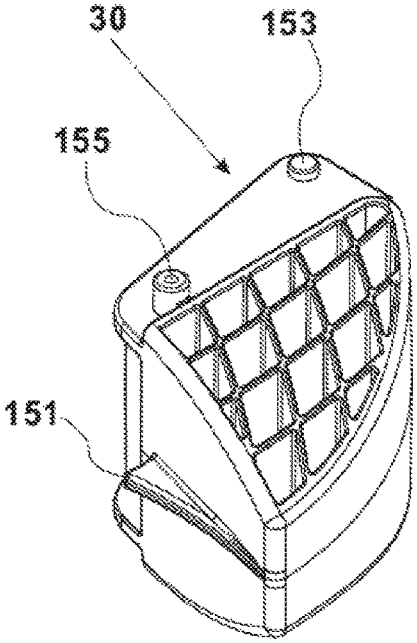
FIG. 6B schematically illustrate perspective view of a wedge in accordance with an exemplary embodiment of the present invention.

Referring to FIG. 6B wedge 30 includes two pivoting rigid elements 153 facing each other which are configured to allow sliding the wedge forward and backwards along the rail 15. The two pivoting rigid elements 153 used to form in association with rail 15, a movable pivot connection where the wedge 30 has a limited freedom to rotate around the movable pivot connection when wedge 30 is not locked for example to rail 15. Wedge 30 includes two opposite locking rigid elements 155 which are used in association with one or more slots 152 for fixing the wedge 30 to rail 15. By pressing the wedge 30 towards the rail 15 when locking rigid elements are aligned with one or more slots 152 wedge 30 is fixed to slot 152.

As described earlier, the rail 15 of the backrest plate 10 is in line with the rail 25 of the support plate 20. Therefore, in order to facilitate complete folding of the foldable backrest 1, the rail 15 of the backrest plate 10 and the rail 25 of the support plate 20 are configured to allow complete folding without one interfering with the other.

The presence of one wedge 30 that allows changing of the angle 500 between the backrest plate 10 and the support plate 20 is preferable over prior art sitting devices and backrests. It is more comfortable to slide the wedge 30 along the rail 15 of the backrest plate 10 in order to change the angle 500, even while still using the foldable backrest, compared to prior art sitting devices and backrests where there is need to stand up and change the angle of lying.

As illustrated for example in FIGS. 5A-5C, the wedge 30 and the backrest plate 10 bear the pressure applied by a user leaning on the backrest plate 10. When the angle 500 is high, as illustrated for example in FIG. 5A, the pressure applied on the backrest plate 10 and the wedge 30 is lower than the pressure applied on the backrest plate 10 and the wedge 30 when the angle 500 is lower, as illustrated for example in FIGS. 5B-5C. Therefore, the backrest plate 10 and the wedge 30 are configured to bear such level of pressure, for example by being made of a rigid material as described above. In addition, according to one embodiment, the backrest plate 10 is designed in a manner that places the rail 15 in line with the spinal column of the user leaning his back on the backrest plate 10. Thus, the part of the backrest plate 10 on which the rail 15 resides bears most of the pressure applied by the user's back. This further allows freedom in the design of the backrest plate 10 and the support plate 20. As long as most of the pressure applied by a user's back is carried by the part of the backrest plate 10 on which the rail 15 resides, which is in line with the user's spinal column, the backrest plate 10 and/or the support plate 20 may have any structure, not necessarily symmetrical, without interfering with the function of the foldable backrest 1 and without influencing the strength of the foldable backrest 1 in general.

These features are different and advantageous over prior art seating devices and backrests, illustrated for example in FIGS. 1A-1D and 2A-2D. In the prior art seating devices and backrests, especially the portable ones, the backrest is made of a flexible material, for example fabric, being held by a rigid frame. Most of the pressure applied by a user leaning on the prior art backrest is applied on the flexible material, which might be eroded in time. Rigidness of the entire backrest plate 10, as described above, overcomes this drawback.

In addition, in prior art seating device as illustrated for example in FIGS. 1A-1D and prior art backrests as illustrated for example in FIGS. 2A-2D, the angle of slant of the backrest is determined by two rods pivotally connected to the rigid frame of the backrest and a third rod connecting their distal edges. This construct fits into stoppers aligned on a base. This prior art feature is entirely different from the mechanism of determining the angle of the backrest plate 10 of the present subject matter, which involves a wedge 30 configured to slide along a rail 15 on the backrest plate 10, and held by tooth-like structures 252, or any kind of stopping element, on the rail 25 of the support plate 20, for example as detailed above. This embodiment is advantageous over the prior art mechanism for determining the angle of slant of the backrest, since the wedge 30, is positioned on the rail 15 of the backrest plate 10 and can bear a higher-pressure level compared to the prior art mechanism. Furthermore, the wedge 30 of the present subject matter is stiffer than the rods of the prior art mechanism, and therefore advantageous over the prior art mechanism.

Another difference between the foldable backrest 1 of the present subject matter and prior art seats and backrest is in the nature of the component of the backrest or seat that is configured to be in contact with a surface on which the seat or backrest is positioned. The prior art seats and backrests, as illustrated for example in FIGS. 1A-1D and 2A-2D, comprise legs or frame-like structures that are in contact with a surface. Such components may not be strong enough in some occasions and may collapse or break when a high-pressure force is applied on them. This is because the area of these components that is in contact with the surface is relatively small—tips of legs or a thin rod. On the other hand, the contact area of the support plate 20 of the foldable backrest 1 of the present subject matter is large. The entire area of the support plate 20 is in contact with the surface, thus rendering strength to the support plate 20 and an ability to bear high pressure forces. In addition, the rigidity of the support plate 20 allows positioning of the support plate 20 on any type of surface—solid like a rock, soft like sand, and the like, without interfering with its function—support and bearing of high-pressure forces.

According to one embodiment, the foldable backrest 1 further includes a detachable sheet 50, as can be seen for example in FIGS. 5A-5C. The sheet 50 is made of a flexible material, for example fabric. According to one embodiment, the sheet 50 may be attached either to the backrest plate 10 or the support plate 20, adjacent to the pivot 40. The sheet 60 is attached by any means known in the art, for example but not limited to, hook-and-loop connector; male-female connectors like half-ball cover buttons, attached to the sheet 50 and to the backrest plate 10 or support plate 20; slots in the backrest plate 10 or the support plate 20 used for tying the sheet 50 for example with threads, and the like. When a user sits on the detachable sheet 50 the user prevents the support plate 20 and backrest plate 10 to move away from the user by applying his weight on the detachable sheet 50 which is attached to the backrest 1.

According to one embodiment, the sheet 50 is configured to be seated on when the foldable backrest 1 is placed on a surface, like ground, and the sheet 50 is spread out on the ground, while still attached to the backrest plate 10 or the support plate 20. The sheet 50 is spread out in a manner that allows a user to sit on the sheet 50 while leaning his back on the backrest plate 10.

Figure 8:
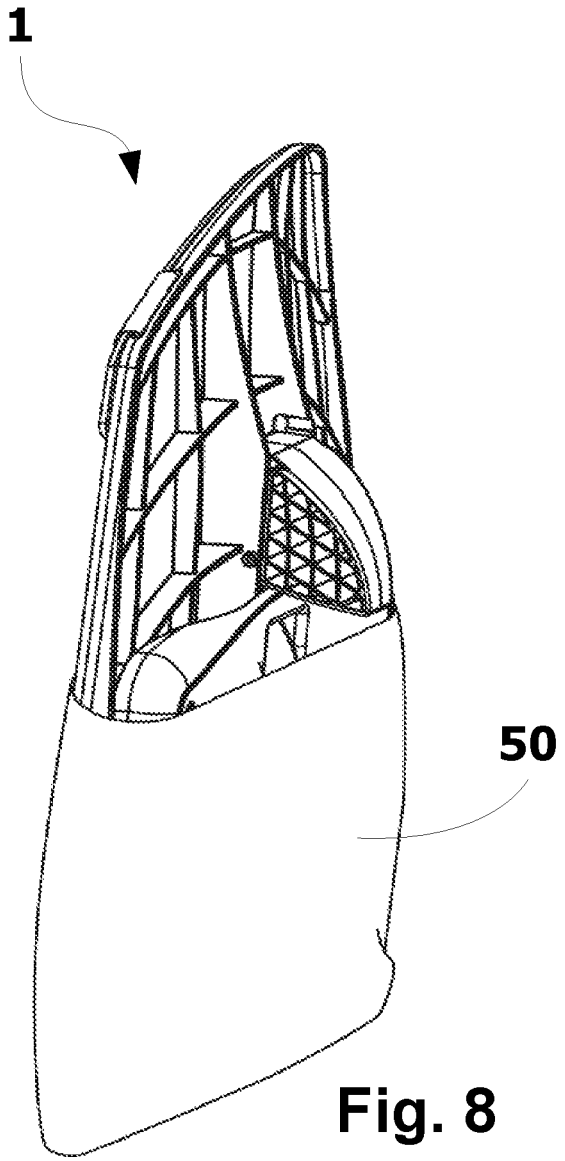
FIG. 8 schematically illustrates, according to an exemplary embodiment, a back view of a completely closed foldable backrest inserted within a sheet renders a sac-like structure.

Referring to FIG. 8, according to another embodiment, when the foldable backrest 1 is in a completely closed state, the sheet 50 is configured to be folded and secured in a manner that enables storage of items in a sac-like structure made by the sheet 50.

Figure 9:
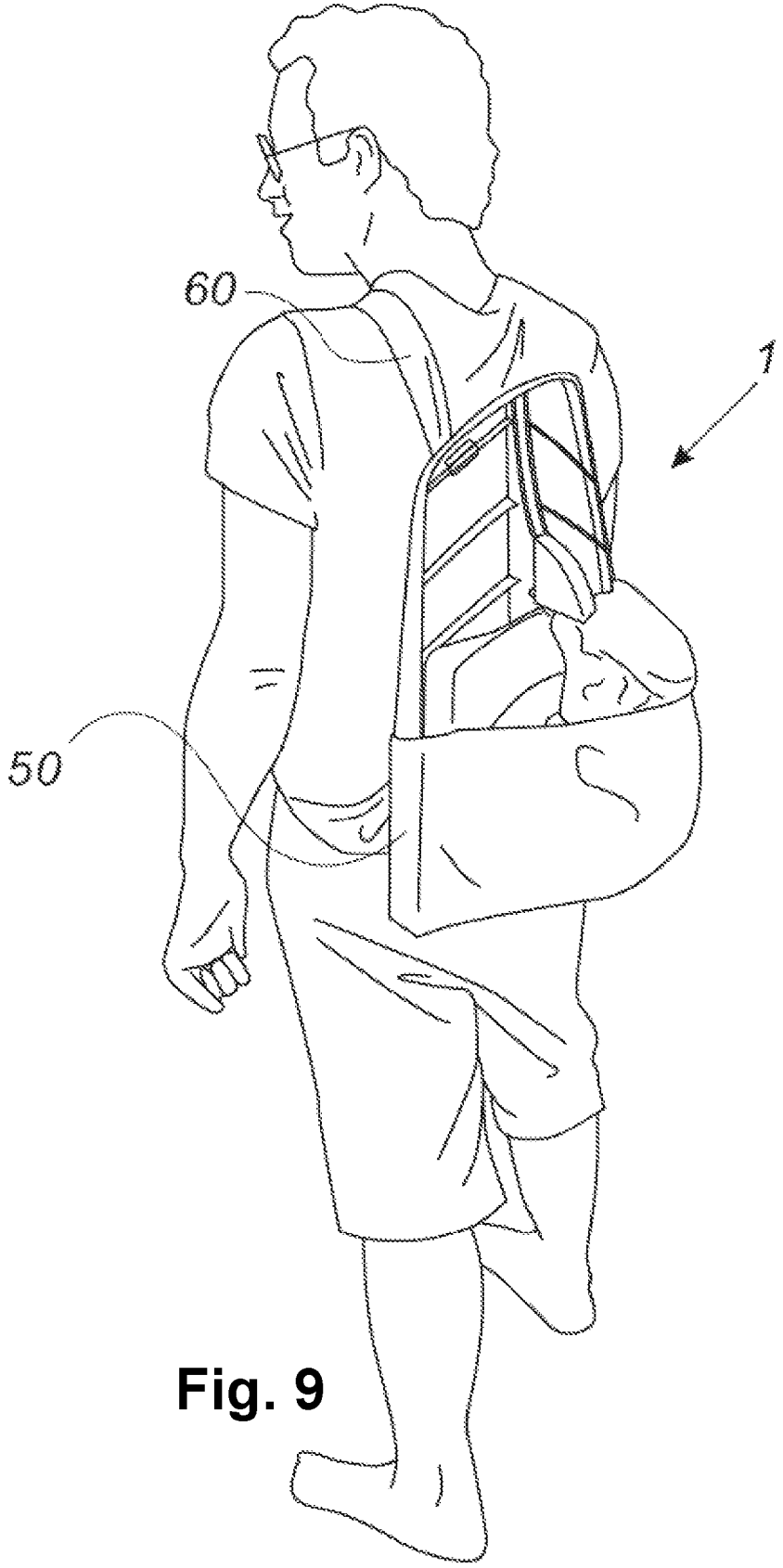
FIG. 9 illustrates, according to an exemplary embodiment, a perspective view of a user carrying the foldable backrest in a completely closed state as backpack, and the sheet renders a sac-like structure.

FIG. 9 illustrates, according to an exemplary embodiment, a perspective view of a user carrying a foldable backrest in a completely closed state, while sheet 50 renders a sac-like structure. As seen in FIG. 9, when the foldable backrest 1 is in a completely closed state, items may be held in a sac-like structure that is formed by the sheet 50. In addition, in the completely closed state, the sheet 50 is further configured to secure the complete closure of the foldable backrest 1, namely the sheet is configured to prevent separation of the support plate 20 from the backrest plate 10, for example during storage or carriage of the foldable backrest.

According to an additional embodiment, the foldable backrest 1 further comprises at least one strap 60, as can be seen in FIG. 9. The at least one strap 60 is attached to at least one component of the foldable backrest 1 in a manner that enables carriage of the foldable backrest 1 as a backpack by a user while wrapping the at least one strap 60 over a part of the user's body, for example a user's shoulder, as seen in FIG. 9, neglecting the need to carry the foldable backrest 1 by hand. The at least one component to which the strap 60 is attached may be the backrest plate 10 and/or the support plate 20 and/or the pivot 40, and/or the sheet 50. According to one embodiment, the strap 60 is permanently attached to the at least one component of the foldable backrest 1. According to another embodiment, the strap 60 is releasably attached to the at least one component of the foldable backrest.

Figure 10:
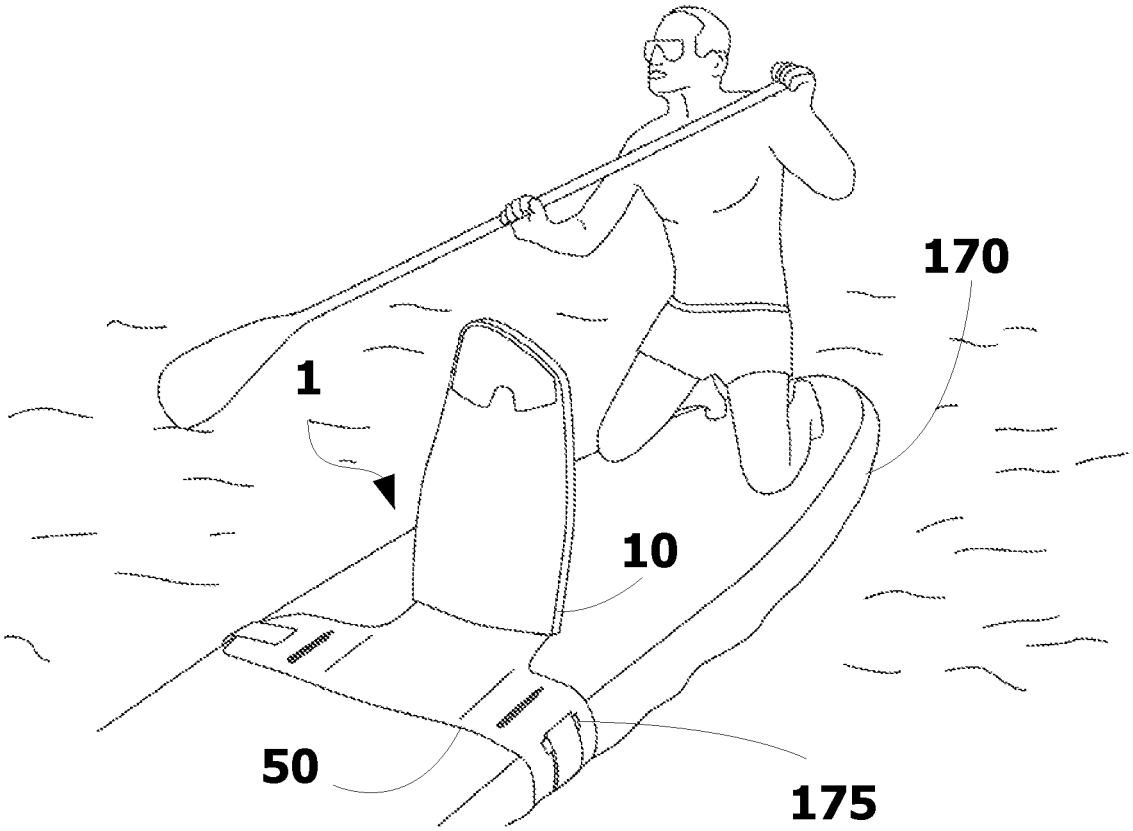
FIG. 10 illustrates a perspective view of a backrest according to one embodiment of the present invention attached to a surfboard by a fastening means.

Referring to FIG. 10 there is shown a surfer seating on a surfing board 170 and a backrest 1 fastened to the surfing board by a fastening means such as but not limited to Hook-and-loop fasteners. The backrest in this configuration allows a user (not shown) to seat comfortably on the surfing board. From the sides of sheet 50 extends adjustable straps 175, preferably VELCRO® straps with buckle which are long enough and are used for releasably fastening the backrest 1 to surfing board 170. When the backrest 1 is fastened by straps 175 to board 170, the fastening is strong enough to withstand for example situations where the board 170 is in an upside-down position and there are powerful sea waves. When the backrest 1 is completely folded and straps 175 are disconnected from board 170, sheet 50 is folded around axes 40 towards the back surface of support plate 20, straps 175 are fastened on the front surface of backrest plate 10 thus, creating a sac-like structure and with strap 60 creating a backpack structure for carrying the backrest 1 on the user back as shown for example in FIG. 9.

BENEFITS OF THE PRESENT INVENTION

Some of the benefits of the present invention are described below. One of the benefits of the present invention is that the backrest components can be modular for example.

Figure 11:
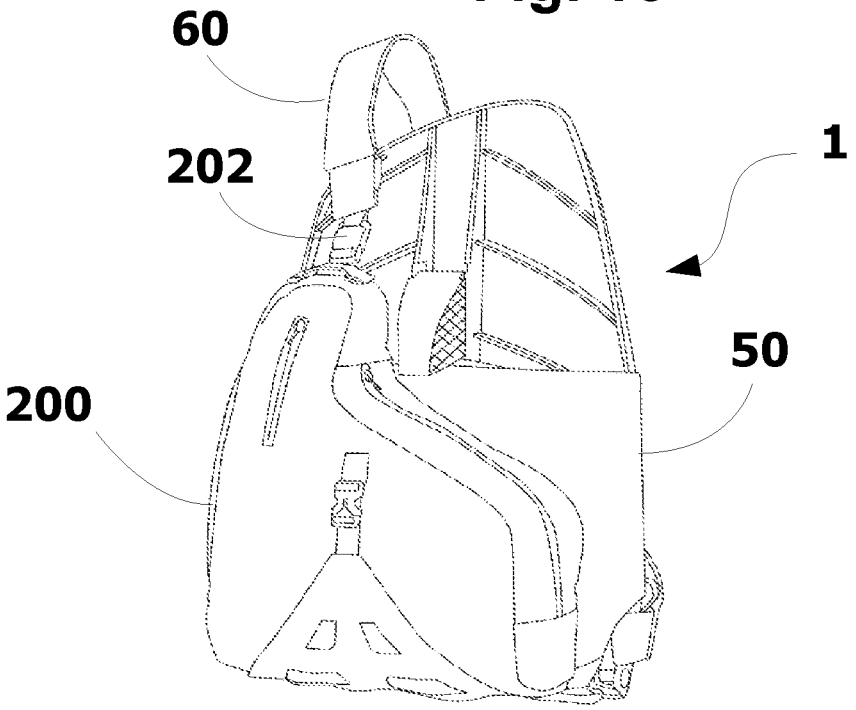
FIG. 11 illustrates a backpack with a strap configured to carry the backrest while foldable sheet renders a sac-like structure.

A backpack 200 can be attached also to strap 60 where strap 60 is configured to carry both the backrest 1 where sheet 50 renders a sac-like structure and to carry backpack 200 as shown for example in FIG. 11. The backpack strap can be connected to the backpack by any suitable fastening means such as but not limited to feedlock connection 202, using ladder-lock buckle and etc.

Another benefit of the present invention is because sheet 50 is flexible the user can use the backrest and seat on any terrain even when the surface is not flat. The user can use the backrest on any type of surface—solid like an uneven bare rock, soft like sand, and the like, without interfering with its function—support and bearing of high-pressure forces.

Yet another benefit of the present invention is that the backrest can be used also on a moving surface such as but not limited to a Stand Up Paddle Board.

Another benefit of the present invention is to provide a foldable backrest that allows sitting on a surface, and when carrying the folded backrest from one place to another keeping the user hands free from holding the backrest and accessible for performing any desired activity with his hands.

Yet another benefit of the present invention is that the features of the present invention allows a freedom to design the backrest in any desired commercial shape for example in a form of a surfboard like shape as shown for example in FIG. 9.

Another benefit of the present invention is that the range of the angle 500 can be configured from 15° or less up to 90°.

Another benefit of the present invention is that the support plate 20 allows to be significantly short and thus making the backrest more space efficient, both in carrying position and in open position of backrest 1.

Another benefit of the present invention is that the use of a single bulk piece as a wedge 30 in lieu of two support beams as commonly used in prior art, provides added structural strength and flexibility of the Backrest plate 10.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A foldable backrest, comprising:

a backrest plate, operatively configured to be leaned upon by a back of a user;

a support plate pivotally connected to said backrest plate by a pivotal connection and operatively configured to be placed upon a support surface upon which a user desires to sit or lay down on;

a rigid wedge configured to form a desired angle between said backrest plate and said support plate when said rigid wedge is interposed between central regions of a rear side of said backrest plate and a top side of said support plate and as permitted by said pivotal connection defined between said backrest plate and said support plate, and which is movable along said central regions of both said backrest plate and said support plate to different positions between said backrest plate and said support plate so as to effectively permit different desirable angles to be formed between said backrest plate and said support plate as a result of said pivotal connection defined between said backrest plate and said support plate; and first wedge-stopping structure defined upon said backrest plate, and second wedge-stopping structure defined upon said support plate, for fixing said movable rigid wedge at different positions upon both said backrest plate and said support plate such that said rigid wedge will effectively form said desired angles between said backrest plate and said support plate while providing support to the back of the user while the user sits or lies upon the support surface.

2. A foldable backrest according to claim 1, wherein:

said first wedge-stopping structure defined upon said backrest plate comprises a first rail having a plurality of slots defined therein;

wherein said first rail is disposed upon said rear side of said backrest plate that is disposed opposite to a front side of said backrest plate upon which a user's back will be supported; and wherein said second wedge-stopping structure defined upon said support plate comprises a second rail having a plurality of tooth-like structures, whereby said movable rigid wedge is adapted to slide along said first rail of said backrest plate and be fixed within a particular one of said plurality of slots defined within said first rail of said backrest plate, and to slide along said second rail of said support plate and be held in place by a particular one of said tooth-like structures defined within said second rail of said support plate.

3. A foldable backrest according to claim 2, wherein said foldable backrest further comprises:

a locking device for locking said foldable backrest in a completely closed state which is used during storage or carrying said foldable backrest upon one's back as a backpack.

4. A foldable backrest according to claim 2, wherein:

said rigid wedge further comprises a pair of rigid pivoting elements disposed within tracks so as to permit said wedge to be moved forwards and backwards along said first rail of said backrest plate as well as to provide pivotal connections with respect to said backrest such that said wedge has freedom to rotate around said pivotal connections when said wedge is not fixed within a particular one of said plurality of slots of said backrest plate.

5. A foldable backrest according to claim 2, wherein:

said wedge further comprises a pair of rigid locking elements which are adapted to engage particular ones of said plurality of slots defined upon said first rail of said backrest plate so as to fix the location of said wedge upon said first rail of said backrest plate.

6. A foldable backrest according to claim 3, wherein:

said locking device comprises a locking element;

said backrest plate has a first longitudinal extent, said support plate has a second longitudinal extent, and said first longitudinal extent of said backrest plate is greater than said longitudinal extent of said support plate;

whereby, when said wedge is fixed within said slot of said plurality of slots defined upon said first rail of said backrest panel that is most distant from said pivotal connection, said locking element engages said support plate so as to prevent said support plate from opening with respect to said backrest plate.

7. A foldable backrest according to claim 6, wherein:

said locking device is is capable of locking said foldable backrest in a completely closed state when said wedge is fixed within a slot of said plurality of slots defined upon said rail of said backrest panel that is most distant from said pivotal connection.

8. A foldable backrest according to claim 1, wherein:

said foldable backrest further comprises a detachable sheet attached to either one of said backrest plate or said support plate at a position adjacent to said pivotal connection, wherein said sheet is configured to be seated upon by the user, while the sheet is attached to said backrest plate or support plate, after said foldable backrest has been disposed at a predetermined angular orientation on the support surface so as to prevent said support plate and said backrest plate from moving away from the user.

9. A foldable backrest according to claim 8, wherein:

said sheet is attached to either one of said backrest plate or said support plate by fasteners selected from a group comprising hook-and-loop fasteners, and male-female fasteners and threads.

10. A foldable backrest according to claim 8, wherein at least one portion of said sheet is padded.

11. A foldable backrest according to claim 8, wherein:

when said foldable backrest is in a completely closed state, said sheet is configured to be folded and secured in a manner that enables storage of items in a sac-like structure made by said sheet.

12. A foldable backrest according to claim 8, wherein:

in the completely closed state, said sheet is configured to ensure that said foldable backrest remains in a closed state as a result of preventing separation of said support plate from said backrest plate when said foldable backrest is being transported in a backpack manner.

13. A foldable backrest according to claim 8, wherein:

said sheet further comprises fasteners extending outwardly from opposite sides of said sheet for fixing said backrest union a surface.

14. A foldable backrest according to claim 13, wherein:

said surface, upon which said backrest may be fastened, comprises a paddle board.

15. A foldable backrest according to claim 1, wherein:

said foldable backrest further comprises at least one detachable strap which is attached to at least one portion of said foldable backrest in a manner that enables carriage of said foldable backrest by a user in a backpack manner.

16. A foldable backrest according to claim 15, wherein:

said foldable backrest further comprises a detachable backpack attached to said foldable backrest by said at least one detachable strap.

* * * * *